United States Patent [19]

Morgenthaler

[11] 4,093,929

[45] June 6, 1978

[54] METHOD OF SYNTHESIZING CYLINDRICALLY SYMMETRIC STATIC MAGNETIC FIELDS IN A LOCALLY SATURATED MAGNET AND APPARATUS PROVIDING SAID FIELDS

[75] Inventor: Frederick R. Morgenthaler, Wellesley Hills, Mass.

[73] Assignee: Massachusetts Institute of Technology, Cambridge, Mass.

[21] Appl. No.: 634,676

[22] Filed: Nov. 24, 1975

[51] Int. Cl.[2] ..... H01P 1/18; H01P 1/20; H01P 9/30; H01F 3/10

[52] U.S. Cl. ..... 333/31 R; 333/30 R; 333/31 A; 333/73 R; 335/282

[58] Field of Search ..... 333/29, 30 R, 30 M, 333/24.1, 24.2, 73 R, 1, 21 R, 31 R, 31 A; 335/215, 227, 229, 282; 330/4.8, 4.6, 5.5

[56] References Cited

U.S. PATENT DOCUMENTS

| | | | |
|---|---|---|---|
| 3,290,622 | 12/1966 | Hair | 333/24.1 |
| 3,309,628 | 3/1967 | Olson | 333/21 R X |
| 3,353,118 | 3/1967 | Olson et al. | 333/21 R X |
| 3,593,215 | 7/1971 | Moore | 333/30 M |
| 3,671,888 | 6/1972 | Szente et al. | 333/73 R |

*Primary Examiner*—Alfred E. Smith
*Assistant Examiner*—Marvin Nussbaum
*Attorney, Agent, or Firm*—Arthur A. Smith, Jr.; Robert Shaw

[57] ABSTRACT

A method that permits essentially exact synthesis of a cylindrically symmetric static magnetic field of specified and fixed characteristics and either spatially uniform or non-uniform, as required, in a magnet of arbitrary, but feasible, shape and apparatus that provides such cylindrically symmetric static magnetic field.

22 Claims, 5 Drawing Figures

METHOD OF SYNTHESIZING CYLINDRICALLY SYMMETRIC STATIC MAGNETIC FIELDS IN A LOCALLY SATURATED MAGNET AND APPARATUS PROVIDING SAID FIELDS

The present invention relates to methods of synthesizing magnetic fields in magnetic materials such as ferromagnets and ferrimagnets of arbitrary shape and to apparatus that provides such magnetic fields.

Attention is called to a paper entitled "The Synthesis of Cylindrically Symmetric Static Magnetic Fields in a Locally Saturated Ferromagnet" that accompanies herewith and that is hereby incorporated herein by reference; see also an accompanying paper entitled "Synthesized Linearly Dispersive Microwave YIG Delay Line with Wide Instantaneous Bandwidth," Platzker et al, which gives one important application of the present teaching, hereby incorporated herein by reference.

Prior to the present invention there has existed no way of determining the combined shape of a bias magnetic field and a ferromagnet (or a ferrimagnet) needed to provide an H-field to meet a specified on-axis requirement, with two exceptions: the first exception is that of a ferromagnet in the shape of an ellipsoid in an initially uniform magnetic bias field of sufficient intensity to saturate the ferromagnet and the second exception is a cylindrical ferromagnet in a similar field but with large pole pieces immediately adjacent to the end faces of the cylindrical ferromagent. Also, the pole pieces must be parallel to one another and perpendicular to the axis, and all generating elements of the cylinder must extend far enough to cause negligible fringing. In both cases the magnetic field within the ferromagnet is spatially uniform and both cases represent special and quite similar situations. Whenever there arose, prior to the present teaching, a need that required non-ellipsoidal ferromagnet shapes and/or non-uniform internal magnetic fields, fabrication has been by the cut-and-try approach.

Accordingly, it is a principal object of the present invention to provide a method of synthesizing cylindrically symmetric, static magnetic fields of specified and fixed characteristics in ferromagnets of arbitrary, yet feasible, shapes.

Another object is to provide systems that include ferromagnets of appropriate shapes and associated bias field providing means of appropriate characteristics to supply said magnetic fields of specified and fixed characteristics.

Still another object is to provide such magnetic fields within magnetic materials other than ferromagnets.

A further object is to provide fields with the foregoing characteristics in systems of the type described, for example, in the Platzker et al paper.

A still further object is to provide fields with the foregoing characteristics in other systems, as well.

These and still further objects are discussed hereinafter and are particularly delineated in the appended claims.

The foregoing objects are achieved in magnetic apparatus that includes, in combination, a magnetic material such as a ferromagnet or ferrimagnet that is non-ellipsoidal and non-cylindrical in shape and means creating a bias magnetic field in the region occupied by the magnetic material of sufficient intensity to saturate the same, the shape of the magnetic material and the contours of the bias magnetic field acting, in combination, to provide an internal magnetic field within the magnetic material of specified and fixed exacting characteristics. The concepts herein disclosed can be employed to provide a cylindrically symmetric static magnetic field in a magnet; the static magnetic field so provided can be spatially uniform (i.e., spatially invariable or constant) or the field can be spatially non-uniform (i.e., spatially variable or non-constant or graded); also, the present invention permits use of a ferromagnet or ferrimagnet composed of isotropic materials but it permits use of anisotropic materials, as well.

The invention is hereinafter described with reference to the accompanying drawing in which.

A few preliminary remarks to precede the description of the invention, should be made. In what follows, the term "magnetic bias field" is used to denote the magnetizing field $H_{BF}$ created by magnetic-iron poles (or by the solenoids of FIGS. 3 and 4, discussed later) such as the pole pieces labeled 1A, 1B and 1C in FIG. 1, the pole pieces $1A_1$ and $1B_1$ in FIGS. 2A and 2B, the solenoid labeled $1A_2$ in FIG. 3 or the solenoid labeled $1A_3$ in FIG. 4. The term "initial bias magnetic field" means the field $H_{BF}$ in a space without magnetic material therein; for example, the initial bias magnetic field lines in the space between two pole pieces whose pole faces are parallel to one another and fairly near to one another and orthogonal to the pole faces. But, if a ferromagnet is placed in the space between the pole faces, the field lines will distort; the later is also referred to herein as a magnetic bias field $H_{BF}$. The field within the magnetic material (i.e., ferromagnet or ferrimagnetic crystal (such as, for example, YIG)) labeled 2A in FIG. 1, 2A' in FIGS. 2A and 2B, and 2B in FIGS. 3 and 4, is called an "internal magnetic field" or "internal static magnetic field" $H_I$, where $H_I = H_{BF} + H_d$, $H_d$ being the internal demagnetization field in the crystals 2A and 2B; the term $H_{IR}$ is used herein to denote the internal magnetic field needed to satisfy requirements for a particular use of the magnetized crystal or other magnetic material; and the term $H_{BFR}$ denotes the magnetic bias field required to provide the internal field $H_{IR}$.

As above noted, prior art techniques permits one to provide in a ferromagnet in the form of an ellipsoid an internal magnetic field of spatially uniform (or constant) characteristics; similarly, one can provide an internal magnetic field of spatially uniform (or constant) characteristics in a cylindrical ferromagnet, the conditions as to the cylindrical ferromagnet being that the magnetic biasing means be facing pole pieces that are parallel to one another, effective in extent as to the cylindrical ferromagnet to give an initial magnetic bias field whose field lines are parallel to one another, the ends of the cylinder must touch the pole pieces (i.e., the pole faces) and the cylinder must be one whose ends are perpendicular to its axis. No further discussion is needed to show that the limitations in the prior art place severe restrictions on the choice of a ferromagnet and bias field generating means to fit a requirement.

Figure 3:
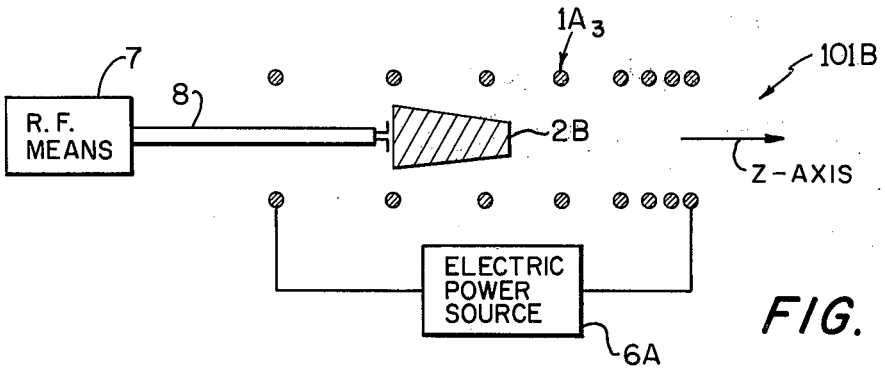
FIG. 3 is a diagrammatic longitudinal section view taken on the sectionalizing plane, of a magnetic system with a ferromagnet like that of FIG. 1 but differing in shape therefrom, and having solenoidal coils that replace the pole pieces.
Figure 4:
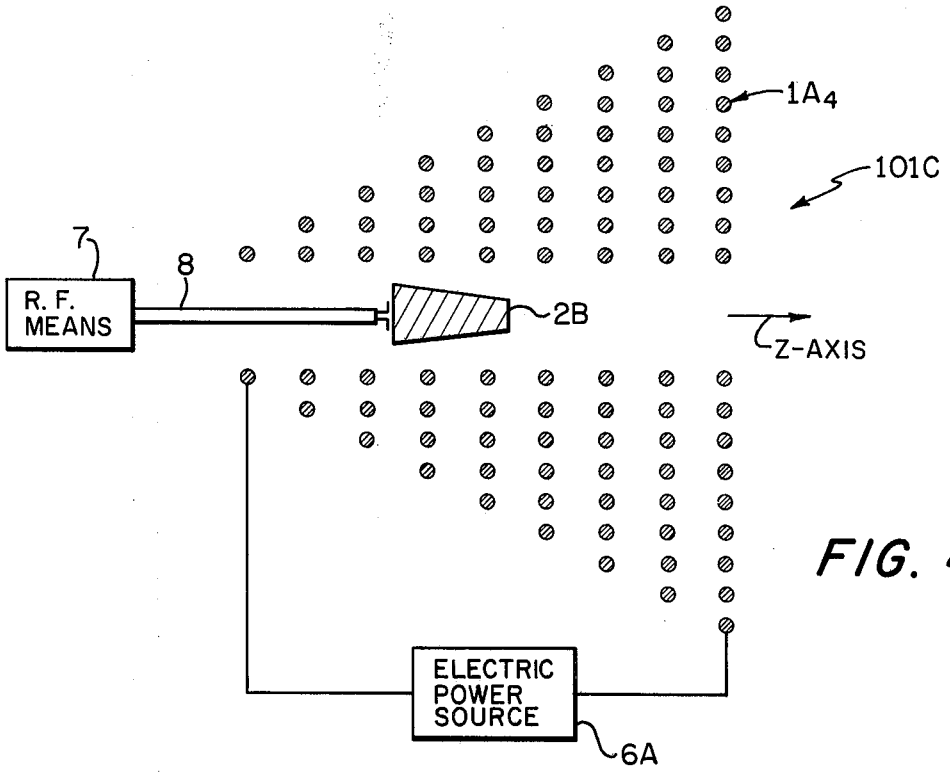
FIG. 4 is alongitudinal section view, taken on the sectionalizing plane, partly block diagram in form, of a modification of the system of FIG. 3.

The present invention, on the other hand, permits one to satisfy magnetic field requirements that are not so limited, that is, to supply in a ferromagnet an internal static magnetic field $H_{IR}$ that is (1) spatially uniform (e.g., nongraded) or (2) that is spatially non-uniform or graded, and the field $H_{IR}SO$ supplied can be furnished in odd-shaped cylindrically-symmetric crystals such as, for example, the crystals 2B in FIGS. 3 and 4 in the shape of a frustum of a cone. Further, the present teaching allows the determination of the contours of the outer field equipotentials with great exactness.

Figure 1:
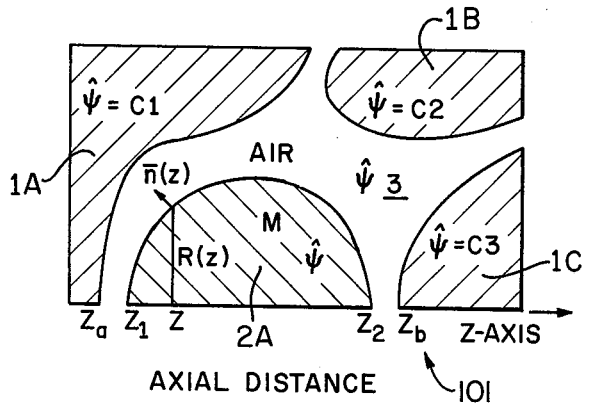
FIG. 1 is a diagrammatic longitudinal section view showing a ferromagnet and three pole pieces to provide a magnetic field within the ferromagnet of specified and fixed characteristics, the view being on the sectionalizing plane and being the upper half only of the elements depicted.

Referring now to FIG. 1, apparatus 101 comprises the ferromagnet or ferrimagnetic crystal (e.g., YIG) 2A disposed within and mostly surrounded by the pole pieces 1A, 1B and 1C. To simplify the apparatus 101, it is shown diagrammatically. It should be kept in mind, however, that in actual apparatus the crystal 2A would be a solid formed by revolving the curved outline of FIG. 1 about the z-axis; and the pole pieces 1A, 1B and 1C would also be solids formed by revolving the shapes shown about the same z-axis. The shape of the crystal is more or less established by the particular technical application for it; the present teaching allows a choice of pole pieces that will give the necessary static magnetic field $H_{IR}$ within the crystal 2A, assuming, of course, that the magnetic field requirements are possible at all; that is, appropriate pole pieces and spacing can be determined in accordance with the present teaching if crystal shape is not one which renders the choice impossible.

The synthesis produced further determines the characteristics of the pole pieces for a given ferromagnetic crystal (or ferrimagnetic crystal). First it is necessary to find the bias field $H_{BFR}$ (i.e., the bias field in the air region labeled 3 in FIG. 1) that meets the on-axis field requirements inside the cylindrically symmetric but as yet unbounded ferromagnet 2A of specified magnetization M; in FIG. 1 the axial limits are $z_1$ and $z_2$ and $z$ is any axial point between the two, i.e., $z_1 < z < z_2$. A convenient boundary radius R(z) is chosen subject to $R(z_1) = R(z_2) = 0$. There then is chosen a convenient series expansion for the Laplacian scalar potential outside the ferromagnet 2A, and the boundary conditions over the entire R(z) are matched; the expansion is then solved for the coefficients of the outer potential. A plot is then made of the equipotentials (called $\psi_i$ herein) of the outer field and two or more such equipotentials are chosen that are appropriate (such appropriate equipotentials are designated $\psi_{iR}$ herein) to serve as surface contours of high permeability magnetic pole pieces, that is, the surface contours (i.e., pole faces) of the high permeability magnetic pole pieces 1A, 1B and 1C are placed or positioned along calculated magnetic potentials which are the required equipotentials (i.e. $\psi_{iR}$) prior to the pole pieces being so placed (it is known that such high permeability magnetic pole pieces are everywhere at equipotential once so placed, irrespective of whether equipotentials, at the spatial position of the pole faces, existed prior to introduction of the pieces into the system 101; hence, if the pole pieces are not properly positioned at equipotentials $\psi_{iR}$, the magnetic field lines will be distorted and the required field $H_{iR}$ will not be generated); said another way, the positioning of the pole pieces at the equipotentials $\psi_{iR}$ and the level of the field $H_{BF}$ produced thereby are such that the internal field $H_{IR}$ is achieved within the magnetic material. The shape and location of the magnetic pole pieces 1A, 1B and 1C, were so established. If the solution found to be in accordance with the foregoing procedure is one difficult or impossible to implement, then the shape of the crystal 2A must be changed since, in the circumstance, the boundary conditions make a solution difficult or impossible. The mathematical determination of the parameters of the pole pieces 1A, 1B and 1C in the light of the contour, size and internal field requirements of the crystal 2A is now given.

In the absence of anisotropy, the well known equations governing the dc H field (i.e., $H_I$ herein) in a ferromagnet that is everywhere locally saturated (no domain structure) are $$\overline{M} \times \overline{H} = 0 \; (\overline{M} \cdot \overline{H} > 0) \tag{1}$$

$$|\overline{M}| = M \tag{2}$$

$$\nabla \times \overline{H} = 0 \tag{3}$$

and $$\nabla \cdot (\overline{H} + \overline{M}) = 0 \tag{4}$$

In terms of the magnetic scalar potential $\psi$, $$\overline{H} = -\nabla\psi \text{ and } \overline{M} = \frac{-\nabla\psi}{|\nabla\psi|} M$$

satisfy Eqs. (1), (2), (3). Therefore, Eq. (4) may be expressed as $$\nabla \cdot [(1 + M/|\nabla\psi|)\nabla\psi] = 0 \tag{5}$$

(As used herein $\psi$ denotes the unique magnetostatic potential required to establish the internal magnetic field $H_{IR}$ of predetermined and exacting characteristics having, for example, the values $a_o'(z)$ along the axis of symmetry or axis of revolution of the magnetic material, $\psi_i$, as above indicated, denotes equipotentials in the magnetostatic potential $\psi$ prior to positioning the pole pieces 1A, 1B and 1C about the crystal 2A, and $\psi_{iR}$ denotes the equipotentials that gives the required internal field $H_{IR}$.)

This nonlinear equation reduces to Laplace's Equation in the event that M = 0. Because of the axis of the cylindrically symmetric ferromagnet is assumed nonsingular, an appropriate expansion of $\psi$ is $$-\psi = \sum_{n=0}^{\infty} a_{2n}(z)\, r^{2n} \tag{6}$$

One could substitute Eq. (6) into Eq. (5) and expand the result so as to find $a_2$ in terms of $a_o$ and its derivatives and so on. However, it is more convenient to separately expand $\overline{M}$ as $$\overline{M} = M\,[\bar{i}_z \sum_{n=0}^{\infty} b_{2n}(z)\, r^{2n} + \bar{i}_r \sum_{n=0}^{\infty} b_{2n+1}(z) r^{2n+1}] \tag{7}$$

and use Eqs. (1), (2) and (4). The result is three sets of constraints, respectively $$\sum_{n=0}^{s} [a'_{2n} b_{2(s-n)+1} - 2(s+1-n) a_{2(s+1-n)} b_{2n}] = 0 \tag{8a}$$

$$\sum_{n=0}^{s} [b_{2n+1} b_{2(s-n)+1} + b_{2n} b_{2(s+1-n)}] + b_o b_{2(s+1)} = 0 \tag{8b}$$

$$4(s+1)^2 a_{2(s+1)} + 2(s+1) M b_{2s+1} + a''_{2s} + M b'_{2s} = 0 \tag{8c}$$

where the primes denote differentiation with respect to $z$ and $s = 0, 1, 2, 3 \ldots$. In addition, $$b_o^2 = 1 \text{ and } b_o a'_o > 0.$$

In the foregoing expressions and elsewhere herein $a_o'$ and $a_o'(z)$ are equivalent terms representing the predetermined and exacting on-axis characteristics of the field $H_I$ inside the magnetic crystal or other magnetic material (that is, $a_o'$ or its equivalent $a_o'(z)$ designates the field $H_{IR}$, on-axis in the crystals 2A . . .); the characteristics $a_o'$ or $a_o'(z)$ are specified to meet the exacting requirements laid down, for example, in the Morgenthaler patents noted later herein. Also, as used herein, $r$ (or R) designates the radial (or other) distance from the z-axis; $a_{2n}(z)$ and $b_{2n}(z)$ must satisfy the expressions 8(*a*), 8(*b*) and 8(*c*) above; and $s$ and $n$ are integers.

Because, by assumption, the internal field $H_{IR}$ to be synthesized is known on the z-axis, $a_o'(z)$ is specified over $z_1 < z < z_2$ and, in order to insure saturation, is either positive or negative definite over the same interval. (If $a_o'$ were to reverse sign, the region where it went to zero would demagnetize and domain formation could take place). Without loss of generality, taking $a_o' > 0$ and $b_o = +1$, the solution of Eqs. (8), (8*a*), (8*b*) and (8*c*) become respectively, when $s = 0$:

$$b_1 = -\tfrac{1}{2} \frac{a''_o}{a'_o + M} \tag{9a}$$

$$a_2 = \tfrac{1}{2} b_1 a'_o \tag{9b}$$

$$b_2 = -\tfrac{1}{2} b_1^2 \tag{9c}$$

and when $s \geqq 1$ $$b_{2s+1} = \frac{-\frac{1}{2(s+1)}(a''_{2s} + M b'_{2s}) + \sum_{k=1}^{s} [2(s-k+1) a_{2(s-k+1)} b_{2k} - a'_{2k} b_{2(s-k)+1}]}{a'_o + M} \tag{10a}$$

$$a_{2(s+1)} = \frac{a'_o b_{2s+1} - \sum_{k=1}^{s} [2(s-k+1) a_{2(s-k+1)} b_{2k} - a'_{2k} b_{2(s-k)+1}]}{2(s+1)} \tag{10b}$$

$$b_{2(s+1)} = -\left[\sum_{k=1}^{s} b_k b_{2s-k+2} + \tfrac{1}{2} b_{s+1}^2\right] \tag{10c}$$

The various functions $a_{2k}$ and Eq. (6) constitute the desired solution of Eq. (5) and together generate the entire $\overline{H}$ field that is consistent with the on-axis requirement. The number of terms required to satisfactorily approximate the field depends upon the value of $r$, the value of M and the particular function $a_o'$.

If the material has uniaxial magnetic anisotropy oriented along the z-axis, the procedure can be generalized by replacing in Eq. (8a), $$a'_{2n} \rightarrow a'_{2n} - \frac{2K_o}{\mu_o M b_{2n}}$$

where $K_o$ is the uniaxial anisotropy constant. ($K_o < 0$ easy; $K_o > 0$ easy plane). If the anisotropy is not uniaxial with the z-axis, (as for example, a cubic material with [100] of [111] orientation) the formulation may still be used approximately by replacing $K_o$ with the appropriate effective value.

The familiar boundary conditions that must be satisfied at the surface of the ferromagnet (e.g., the crystal 2A) are continuity of $\psi$ and the component $\overline{B}$ normal to the surface. Natural choices for at least some portions of R(z) include

| | |
|---|---|
| 1. $\psi_R$ = constant | (magnetic equipotentials) |
| 2. $\left(\frac{\delta\psi}{\delta r} - \frac{dR}{dz}\frac{\delta\psi}{\delta z}\right)_2 = 0$ | ($\overline{n} \times \overline{M} = 0$, i.e., the contour of the ferromagnetic crystal is parallel to the magnetic field) |
| 3. $\frac{dR}{dz}$ = constant | (cones, cylinders) |

If the z-axis passes through at least some portion of the outer field region, ($z_a < z$ and $z_b > z_2$), the Laplacian potential may be taken nonsingular over all $z$ and expanded in the form $$\hat{\psi} = \hat{a}_o(z) - \frac{\hat{a}''_o(z)}{(1!)^2}\left(\frac{r}{2}\right)^2 + \frac{\hat{a}''''_o(z)}{(2!)^2}\left(\frac{r}{2}\right)^4 \ldots \tag{11}$$

Naturally, if $a_o$ is taken to be $$\begin{Bmatrix} \sin \\ \cos \end{Bmatrix} (kz) \text{ or } \begin{Bmatrix} \sinh \\ \cosh \end{Bmatrix} (kz)\, \hat{\psi}$$

factors into the product of $a_o$ and either $I_o(kr)$ or $J_o(kr)$. However, the usual cylinder functions are not especially convenient because the boundary specification does not lead readily to identification or eigenvalues of $k$. (The optimum choice of $k$ values is discussed hereinafter.) On the other hand, if $a$ is taken to be a finite polynomial or order N, $\psi$ will contain a sufficient finite number of terms to well approximate a suitable potential.

It is also permissible and often advantageous to utilize in the expansion axial multipoles of the form $$\frac{d^n}{dz^n}\left\{\frac{(z - z_o)}{[(z - z_O)^2 + r^2]^{3/2}}\right\} \quad n = 0, 1, 2, \ldots$$

as long as their locations are anywhere within the material boundary. Finally, if the outer region does not contain the z-axis, ($z_a > z_1$ and $z_b < z_2$), the second solutions with logarithmic singularities over all $r = 0$, equal or equivalent to $K_o(kr)$ and $N_o(kr)$, are often convenient.

The matching of $\psi = \hat{\psi}$ and $$(1 + \frac{M}{|\nabla\psi|})\frac{\delta\psi}{\delta n} = \frac{\delta\hat{\psi}}{\delta n}$$

over the entire boundary is carried out in a least squares sense. The outer potential is not over-determined unless one tries to prescribe it over another closed surface (such as one at infinity). Errors can be reduced to acceptably small values by choosing N, the total number of terms in the expansion of $\psi$, sufficiently large. If good judgement is shown in choosing the expansion, N need not be excessive; in the example given hereinafter, N = 10.

Let it be considered that the outer potential has been specified as a series of terms $$-\hat{\psi} = \sum_{j=1}^{N} C_j f_j(r,z) \tag{12}$$

known except for the coefficients $C_j$. The inner potential, $\psi$, has already been determined.

One minimizes the mean square error defined as $$E = \langle\lambda_1^2(\psi - \sum_{j=1}^{N} C_j f_j)^2\rangle + \langle\lambda_2^2[(1 + \frac{M}{|\nabla\psi|})\frac{\delta\psi}{\delta n} - \sum_{j=1}^{N} C_j\frac{\delta f_j}{\delta n}]^2\rangle \tag{13}$$

where the $\langle\ \rangle$ brackets denote averages over the boundary radius and $\lambda_1$ and $\lambda_2$ weight the relative importance of respectively the tangential and normal components of the field. These weights can be functions of position and are defined subject to the condition $$\lambda_1^2 + \lambda_2^2 = 1.$$

The conditions $$\frac{\delta E}{\delta C_j} = 0$$

yield least squares equations of familiar form that are linear in the $C_j$'s.

$$\sum_{j=1}^{N}[\langle\lambda_1^2 f_i f_j\rangle + \langle\lambda_2^2\frac{\delta f_i}{\delta n}\frac{\delta f_j}{\delta n}\rangle]C_j = \langle\lambda_1^2 f_i\psi\rangle + \langle\lambda_2^2\frac{\delta f_i}{\delta n}(1 + \frac{M}{|\nabla\psi|})\frac{\delta\psi}{\delta n}\rangle \tag{14}$$

$$(i = 1,2,3, \ldots N)$$

The solution of Eq. (14) yields an outer field that satisfies the boundary conditions.

Equipotentials of Eq. (12) can serve as the contours of the pole faces of high permeability magnetic pole pieces; the latter when suitably energized will create the required on-axis magnetic field. It is important to realize that although an infinite number of combinations of crystal size, shape and pole piece designs exist, all of which would and can create the desired field, once one has been chosen the field it creates is unique.

EXAMPLE

Figure 2A:
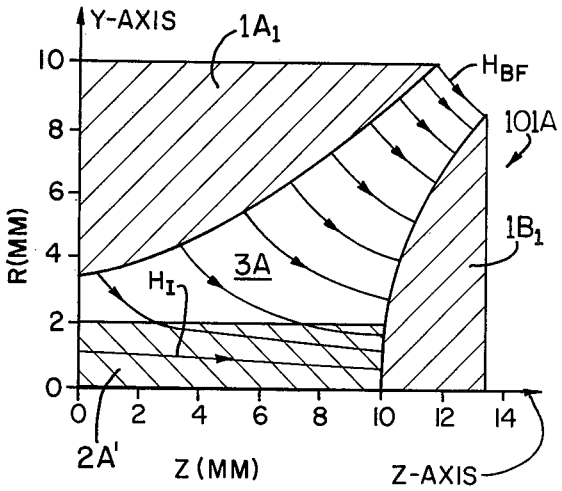
FIG. 2A is a diagrammatic longitudinal section view showing a ferromagnet and two pole pieces to provide a magnetic field within the ferromagnet of specified and fixed characteristics, the view being on the sectionalizing plane and being the upper half only of the elements depicted.

The example is the apparatus shown diagrammatically at 101A in FIG. 2A, comprising the pole pieces 1A$_1$ and 1A$_2$ and the ferromagnet or ferromagnetic crystal 2A'. The external bias magnetic field lines are labeled $H_{BF}$ and the internal magnetic field lines are labeled $H_I$. FIG. 2A shows the portion of the apparatus 101A in the first quadrant, the complete apparatus being formed by revolving the shape form about the *z*-axis; the numerals shown on the *z*-axis and the *y*-axis are dimensions. The *y*-axis dimensions, of course, are doubled in the complete apparatus; see FIG. 2B. The crystal 2A' is a circular cylinder whose ends are almost planar and orthogonal to the *z*-axis. The field $H_I$ in FIG. 3 is a graded or non-uniform field. The faces of the pole pieces 1A$_1$ and 1B$_1$, of course, are not parallel to one another as is required by the prior art for synthesis purposes, and, as shown in the Platzker et al paper, the ferromagnet 2A need not touch the pole piece 1A$_1$; hence, room can be provided to introduce and extract high-frequency, RF signals.

Figure 2B:
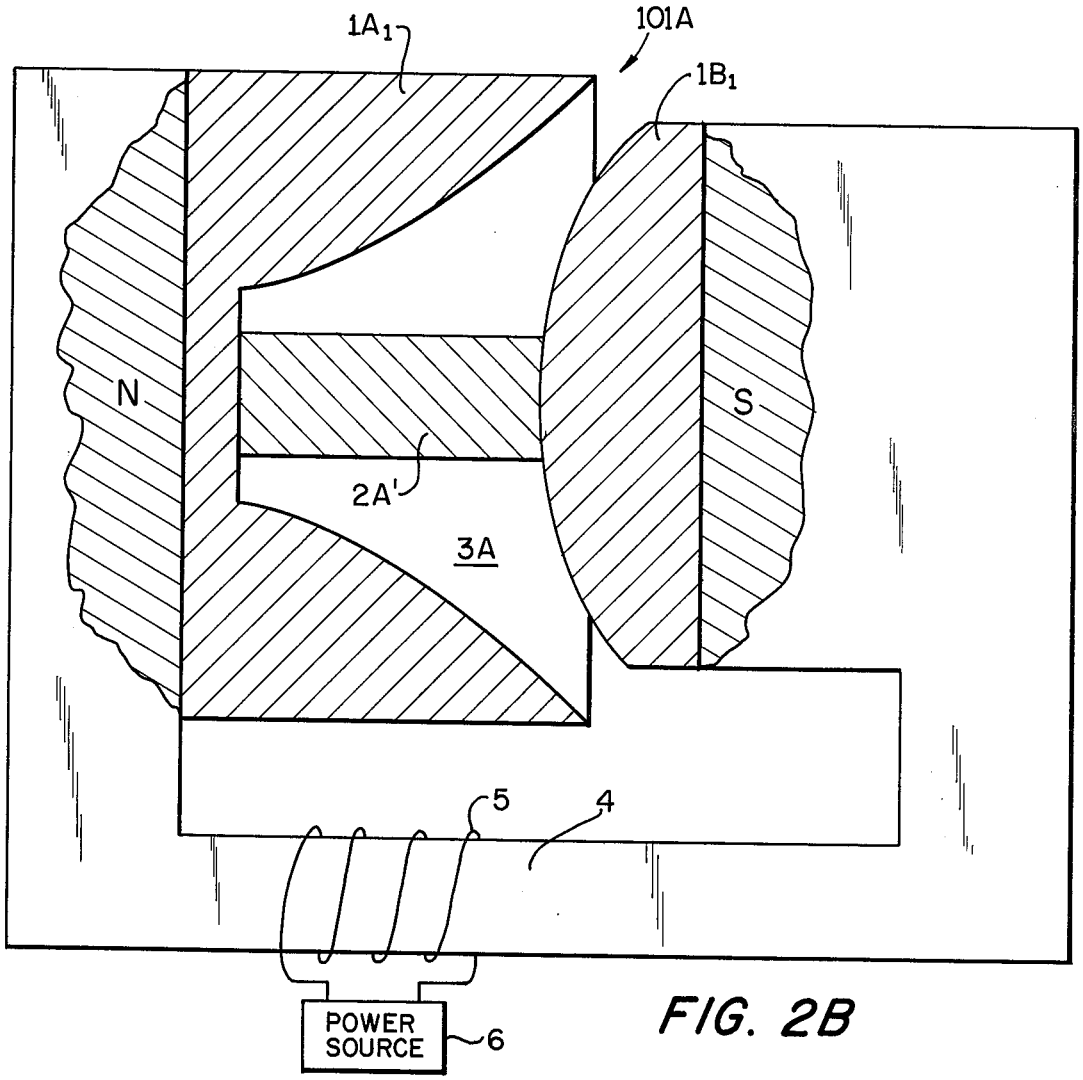
FIG. 2B is a side view, partly cutaway and partly schematic and block diagram in form, of a system that includes the elements of FIG. 2A.

Let it be supposed that the axial magnetic field is to be parabolic in form in the cylindrical ferromagnet 2A' in FIGS. 2A and 2B which is 10 mm. in length; specifically $$H_z(0,z) = 200 + 50\,z^2\ (\text{Oe.})$$

where $$0 < z\ 10\ \text{mm.}$$

and where $H_z$ is the axial component of $H_I$. Further, this field is created inside a ferromagnet cylinder of radius 2 mm., with $4\pi M = 2000$ Gauss, $\lambda_1^2 = \lambda_2^2 = \frac{1}{2}$, and $a_o(z) = z^n$. The functions $f_1$ to $f_{10}$ and the coefficients $C_1$ to $C_{10}$ below together define approximately a suitable outer potential for this example. From Eq. (11) the functions are therefore $$f_o = 1$$
$$f_1 = z$$
$$f_2 = z^2 - \tfrac{1}{2}r^2$$
$$f_3 = z^3 - 3/2\,zr^2$$
$$f_4 = z^4 - 3z^2r^2 + \tfrac{3}{8}r^4$$
$$f_5 = z^5 - 5z^3r^2 + 15/8\,zr^4$$

However, instead of continuing this series, one can switch and include some terms of the "second" solution that is singular when $r = 0$. In particular, $$f_6 = \ln r$$
$$f_7 = z\ln r$$
$$f_8 = (z^2 - \tfrac{1}{2}r^2)\ln r + z^2$$
$$f_9 = (z^3 - 3/2\,zr^2)\ln r + z^3$$
$$f_{10} = (z^4 - 3z^2r^2 + \tfrac{3}{8}r^4)\ln r + z^4 - 3/16\,r^4$$

These latter terms are available because the boundary radius R(z) is non zero over the range of interest $0 < z < 10$ mm. Application of Eq. (14) results in $C_1 = 280.68$
$C_2 = 3.32$
$C_3 = 13.58$
$C_4 = 0.31$
$C_5 = -0.01$
$C_6 = 3.08$
$C_7 = -7.19$
$C_8 = -0.03$
$C_9 = 0.27$
$C_{10} = -0.02$ (the coefficient $C_o$ merely sets the reference potential and is of no consequence, hence it is not included above). Direct evaluation of $H_r$ (i.e., the radial component of $H_I$) and $H_z$ (i.e., the axial component of $H_I$) both just within and without the boundary radius reveals that the maximum matching error is about 2%. With 15 terms, the corresponding errors can be made completely negligible.

The field lines and boundary equipotentials for both the inner and outer regions are shown in FIG. 2A. It will be noted that due to surface magnetic poles the field lines bend as they pass through the boundary and that the ends of the rod 2A', constrained by this particular design to be equipotentials, are nearly planes perpendicular to the z-axis. Therefore, the sample can be well approximated by a right circular cylinder.

As noted above, the representation in FIG. 1 is of elements whose shape on the cutaway plane is as shown, the complete pole pieces 1A, 1B and 1C and the complete crystal 2A being formed by revolving the shapes in FIG. 1 about the z-axis: further, the pole pieces shown are really only the soft-iron pole pieces of a magnetic circuit that further includes a yoke, energizing coils, etc., such as is shown, for example, in FIG. 2B. Also, the shape of the elements in FIG. 1 is determined very accurately by the above mathematics and is, in fact, a shape so calculated (as is, as well, the shape of the elements in FIG. 2A). It will be appreciated that the actual sizes of the elements 1A . . . and 2A in an actual operating system would be much smaller than the sizes of the figures. This applies to the other figures as well. This should be apparent from the 10 mm. length of the crystal 2A' in FIG. 2A and the dimensions given in the accompanying Platzker et al paper. (But other requirements may need larger or smaller crystals than herein shown and magnetic materials 2A, etc., need not be single crystals, or even crystalline.)

The complete system 101A (without the RF input and output of the Platzker et al paper) is shown in FIG. 2B to include a magnetic iron yoke 4 that is energized by a winding 5 energized by a d-c power source 6 to supply the necessary bias magnetic field $H_{BF}$ in the air space marked 3A.

The apparatus marked 101B and 101C in FIGS. 3 and 4, include RF means 7 to introduce radio-frequency signals along a coaxial cable 8 to the crystal 2B in each figure. Appropriate RF-signal loops or antennas at the left face of the crystal 2B serve to introduce the RF signals to the crystal 2A and receive signals from the crystal 2B. (Attention is called to U.S. Pat. Nos. 3,530,302; 3,609,596; 3,811,941; and 3,895,324 of the present inventor for a discussion of signal processing in crystals.) The solenoids $1A_3$ and $1A_4$ are energized from a power source 6A. When the field $H_{BF}$ is generated by a solenoid winding (current sheet) located at the boundary radius, instead of by magnetic pole pieces, one sets $\lambda_1 = 0$ in the above expressions and utilizes only axial multipoles of $\psi$ so that the outer field vanishes as $r \rightarrow \infty$. When $\psi$ has been determined, the condition $\bar{n} \times (\nabla\psi - \nabla\psi)$ determines the required surface current, $\bar{k}$.

It will now be appreciated that the teaching herein allows freedom of choice in terms of the shape of the ferromagnetic or ferrimagnetic crystal used to meet a particular requirement as well as the shape, number and position of the pole pieces or solenoid to create an appropriate magnetic bias field in the region occupied by the crystal. Also, predetermination of the shapes, sizes, etc., of the magnetic elements needed to give the desired internal magnetic field $H_{IR}$ can be accomplished in accordance with the present teaching and $H_{IR}$ can be spatially non-uniform as is required in the usual application.

The procedure outlined and the example given is of the synthesis of a cylindrically symmetric d-c magnetic field that is pre-specified along the symmetry axis of a locally saturated ferromagnet with known saturation magnetization; non-zero, uniaxial magnetic anistropy can also be incorporated into the procedure. The soft-iron pole structure or solenoid winding that is compatible with the boundary shape of the magnetic material is obtained as is a complete description of the field both inside and outside the magnetic material.

The teaching herein permits synthesis of the magnet components required to give predetermined and exacting magnetic fields $H_{IR}$ within the magnetic materials 2A, 2A', etc. The systems thus synthesized are particularly useful for RF filtering requirements and for delay line needs. For example, delay lines having extremely linear time-delay vs. frequency characteristics over extended instantaneous bandwidths can be designed using the synthesis procedure above disclosed. To arrive at the internal field requirements within the particular magnetic material the following expressions may be employed.

$$z \cong \frac{\frac{v}{2} \int_{\omega_1}^{|\gamma \mu_o H \leqq \omega_2} \tau_{(\omega)} d\omega}{|\gamma| \mu_o H} \tag{15}$$

$\tau$ = delay time (sec)
$v$ = appropriate elastic wave velocity (m/sec)
$\omega$ = radian RF frequency (rad/sec)
$\omega_1 < \omega > \omega_2$
$\mu_o = 4\pi \times 10^{-7}$ (Hys/m.)
$H = H_z(r = o,z)$ (amp/m.)
$z$ (meters)

As a more particular example of great practical importance, one can consider the case of linear dispersion for which $$\tau(\omega) = \tau_o + D\omega$$

where $\tau_o$ is the extrapolated value of delay for $\omega = 0$ and the constant D is the dispersion factor of the characteristic. It therefore follows from Eq. (15) that $$\frac{2z}{v} \simeq (\tau_o + \frac{1}{2} D |\gamma| \mu_o H) - (\tau_o + \frac{1}{2} D\omega_1) \frac{\omega_1}{|\gamma| \mu_o H} \tag{16}$$

Eq. (16) is a quadratic equation that can easily be solved for H as a function of z. In the event that $\tau_o = -\frac{1}{2} D\omega_1$ the required inner field on-axis ($H = H_z(r = o,z)$) is itself a linear function of z, namely:

$$H = \frac{\omega_1}{|\gamma| \mu_o} + \frac{4z}{vD|\gamma| \mu_o} \tag{17}$$

The expressions (15), (16) and (17), as discussed in the Platzker et al paper, are suitable for one important mode of delay line that employs spin-elastic wave propagation; differing modes of excitation and/or extraction will necessitate use of different, but similar formulas.

Further modifications of the invention herein disclosed will occur to persons skilled in the art and all such modifications are deemed to be within the spirit and scope of the invention as defined by the appended claims.

What is claimed is:

1. Apparatus that comprises, in combination: a magnetic material; and means creating a magnetic bias field $H_{BFR}$ in the region of the magnetic material of sufficient intensity to effect local saturation of the magnetic material, the shape and magnetic characteristics of the magnetic material and the contours of the magnetic bias field $H_{BFR}$ acting, in combination, to provide a spatially non-uniform internal magnetic field $H_{IR}$ of predetermined exacting characteristics within the magnetic material, said means creating a magnetic bias field $H_{BFR}$ comprising a plurality of high permeability magnetic pole pieces whose surface contours or pole faces are disposed along at least two equipotentials $\psi_{iR}$ of said magnetic bias field $H_{BFR}$.

2. Apparatus as claimed in claim 1 wherein the magnetic material is in the form of a right circular cylinder.

3. Apparatus as claimed in claim 1 wherein the magnetic material is non-ellipsoidal and non-cylindrical in shape.

4. Apparatus as claimed in claim 1 wherein the magnetic material is in the form of an ellipsoid of revolution.

5. Apparatus as claimed in claim 1 wherein said surface contours or pole faces are positioned to establish the unique magnetostatic potential $\psi$ required to establish the internal magnetic field $H_{IR}$ of predetermined exacting characteristics within the magnetic material, said unique magnetostatic potential $\psi$ being found in the expression $$-\psi = \sum_{n=0}^{\infty} a_{2n}(z)\, r^{2n}$$

wherein $z$ denotes the axis of the magnetic material along which the internal magnetic field $H_{IR}$ is everywhere determined and $r$ is the radial distance from the axis, wherein $a_{2n}(z)$ must satisfy the following expressions:

$$\sum_{n=0}^{s} [a'_{2n}\, b_{2(s-n)+1} - 2(s+1-n)a_{2(s+1-n)}\, b_{2n}] = 0$$

$$\sum_{n=0}^{s} [b_{2n+1}\, b_{2(s-n)+1} + b_{2n} b_{2(s+1-n)}] + b_o b_{2(s+1)} = 0$$

$$4(s+1)^2 a_{2(s+1)} + 2(s+1)Mb_{2s+1} + a''_{2s} + Mb'_{2s} = 0$$

and wherein $n$ and $s$ are both integers.

6. Apparatus as claimed in claim 1 wherein the magnetic material is arbitrary in shape.

7. Apparatus as claimed in claim 1 in which the magnetic material is an odd-shaped, cylindrically-symmetric magnetic material.

8. Apparatus as claimed in claim 1 in which the magnetic material is odd shaped.

9. Apparatus that comprises, in combination, a ferrimagnet and means for creating a magnetic bias field $H_{BFR}$ in the region occupied by the ferrimagnet, the shape of the ferrimagnet and the material forming the ferrimagnet being adapted, in combination with the magnetic bias field $H_{BFR}$ to provide a spatially non-uniform internal magnetic field $H_{iR}$ within the ferrimagnet of predetermined characteristics, said means creating a magnetic bias field $H_{BFR}$ comprising magnetic circuit elements appropriately disposed with respect to equipotentials $\psi_{iR}$ of the magnetic bias field $H_{BFR}$ to provide said internal magnetic field $H_{iR}$, the means for creating a bias magnetic field comprising pole pieces whose contours are established to fall upon equipotentials of the magnetic field outside the ferrimagnet.

10. A method of synthesizing a magnetic field that has been prescribed over a finite length or segment of the axis profile (i.e., an on-axis requirement) in a cylindrically symmetric magnetic material, that comprises: choosing a convenient shape and size for the magnetic material; finding the magnetic bias field $H_{BFR}$ that meets the on-axis requirement over the prescribed length inside a cylindrically symmetric, but as yet unbounded, magnetic material of specified magnetization M; choosing a convenient series expansion for the magnetic potential outside the magnetic materal; matching boundary conditions, that is, the tangential H field and the normal B field, over the entire boundary surface of the magnetic material in order to determine the magnetic potential outside the magnetic material; and finding the equipotentials $\psi_{iR}$ of the magnetic field $H_{BFR}$ outside the magnetic material and choosing at least two equipotentials $\psi_{iR}$ that are appropriate to serve to locate the surface contours or pole faces of high permeability magnetic pole pieces.

11. A method as claimed in claim 10 wherein at least one of the size and the shape of the magnetic material is revised, thereby revising the boundary surface, and the further steps repeated.

12. A method as claimed in claim 10 wherein the series expansion chosen is changed and the further steps repeated.

13. A method of determining the physical parameters of the elements needed to provide a magnetic bias field $H_{BFR}$ required to provide some determined graded internal field $H_{IR}$ whose on-axis values $a_o'$ are specified and exacting within a magnetic material of specified shape and dimensions, that comprises: finding the bias field $H_{BFR}$ that meets the on-axis requirement over the prescribed distance inside the unbounded material; choosing a series expansion for the magnetic potential outside the unbounded magnetic material; matching boundary conditions over the entire boundary surface of the magnetic material in order to determine the magnetic potential $\psi$ outside the unbounded magnetic material; finding the equipotentials $\psi_{iR}$ of the magnetic bias field $H_{BFR}$ outside the unbounded magnetic material; and choosing and positioning appropriate magnetic circuit elements to produce the required field $H_{BFR}$ on the basis of said equipotentials $\psi_{iR}$.

14. Apparatus that comprises, in combination: a magnetic material; means creating a magnetic bias field in the region of the magnetic material of sufficient intensity to effect local saturation of the magnetic material, the shape and magnetic characteristics of the magnetic material and the contours of the magnetic bias field acting, in combination, to provide a spatially non-uniform internal magnetic field of predetermined and exacting characteristics within the magnetic material, said means creating a magnetic bias field comprising a plurality of high permeability magnetic pole pieces whose pole faces are disposed along equipotentials $\psi_{iR}$ of the magnetic bias field exterior to said magnetic material; means for introducing RF energy to the magnetic material, the magnetic material acting to effect controlled dispersion of the energy therein; and means for extracting the RF energy from the magnetic material.

15. Apparatus as claimed in claim 14 wherein the magnetic material acts to control the amplitude and/or phase of the extracted RF energy.

16. Apparatus as claimed in claim 14 wherein the magnetic material acts to effect temporal delay of the energy that is a linear function of frequency of the RF energy, said material being symmetric about an axis designated at its $z$-axis, said internal magnetic field at any distance $z$ into the magnetic material from an end face thereof being found in the expression $$\frac{2z}{v} \cong (\tau_o + \frac{1}{2} D \mid \gamma \mid \mu_o H) - (\tau_o + \frac{1}{2} D\omega_1) \frac{\omega_1}{\mid \gamma \mid \mu_o H}.$$

17. Apparatus as claimed in claim 14 wherein the magnetic material acts to effect time delay $\tau(\omega)$ of the energy and wherein the mechanism within the crystal to effect delay employs magnetoelastic wave energy, said magnetic material being symmetric about an axis designated as its $z$ axis, said internal magnetic field along said $z$ axis at any distance $z$ into the magnetic material from an end face thereof being found approximately by $$z \cong \frac{\frac{v}{2} \int_{\omega_1}^{\mid \gamma \mid \mu_o \leq \omega_2} \tau(\omega) d\omega}{\mid \gamma \mid \mu_o H}$$

$\tau$ = delay time (sec)
$v$ = appropriate elastic wave velocity (m/sec)
$\omega$ = radian RF frequency (rad/sec)
$\omega_1 < \omega < \omega_2$
$\mu_O = 4\pi \times 10^{-7}$(Hys/m.)
$H = H_z(r = o,z)$ (amp/m.)
$z$ (meters).

18. Apparatus as claimed in claim 17 wherein the magnetic material is YIG.

19. Apparatus as claimed in claim 14 wherein the magnetic material is YIG.

20. Apparatus that comprises, in combination: a magnetic material; and means creating a required magnetic bias field $H_{BFR}$ in the region of the magnetic material of sufficient intensity to effect local saturation of the magnetic material, the shape and magnetic characteristics of the magnetic material and the contours of the bias magnetic field acting, in combination, to provide a spatially non-uniform internal magnetic field $H_{IR}$ of predetermined exacting characteristics within the magnetic material, said means creating a magnetic bias field $H_{BFR}$ comprising magnetic circuit elements disposed along at least two equipotentials $\psi_{iR}$ of said magnetic bias field $H_{BFR}$ and at appropriate positions so as not to distort said equipotentials $\psi_{iR}$, that is, the pole pieces are so designed, and so disposed so as to force the actual magnetic bias field $H_{BF}$ to coincide with the required magnetic bias field $H_{BFR}$.

21. A method of synthesizing an internal magnetic field $H_{IR}$ of which a single component thereof has been prescribed within a magnetic material, that comprises: choosing a convenient shape and size for the magnetic material; finding the magnetic bias field $H_{BFR}$ that meets the requirement for the internal field $H_{IR}$ within the as yet unbounded magnetic material of specified magnetization M; choosing a convenient series expansion for the magnetic potential $\psi$ outside the magnetic material; matching boundary conditions over the entire boundary surface of the magnetic material in order to determine magnetic potential outside the magnetic material; finding the equipotentials $\psi_{iR}$ of the magnetic field $H_{BFR}$ outside the magnetic material and choosing at least two equipotentials $\psi_{iR}$ that are appropriate to serve to locate the surface contours of the mechanism that generates the magnetic bias field $H_{BFR}$.

22. A method of determining the physical parameters of the elements needed to provide a magnetic bias field $H_{BF}$ required to provide within a magnetic material some predetermined internal field $H_{IR}$ of which a single component thereof is specified, that comprises: finding the bias field $H_{BFR}$ that meets the requirement established on the basis of said single component over a prescribed distance inside the unbounded material; choosing a series expansion for the magnetic potential outside the unbounded magnetic material; matching boundary conditions over the entire boundary surface of the magnetic material in order to determine the magnetic potential outside the unbounded magnetic material; finding the equipotentials $\psi_{iR}$ of the required magnetic bias field $H_{BFR}$ outside the unbounded magnetic material needed to establish said internal field $H_{IR}$; choosing appropriate magnetic circuit elements to produce the required field $H_{BFR}$; and positioning said circuit elements so as not to distort said equipotentials $\psi_{iR}$.

* * * * *